US010602771B2

(12) United States Patent
Jordil et al.

(10) Patent No.: US 10,602,771 B2
(45) Date of Patent: Mar. 31, 2020

(54) SMOKING ARTICLE ASSEMBLY WITH A FITTED TUBE

(71) Applicant: PHILIP MORRIS PRODUCTS S.A., Neuchatel (CH)

(72) Inventors: Yves Jordil, Lausanne (CH); Cecilia Lindholm Delaloye, Preverenges (CH); Emeric Grandjean, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/552,710

(22) PCT Filed: Mar. 17, 2016

(86) PCT No.: PCT/EP2016/055877
§ 371 (c)(1),
(2) Date: Aug. 22, 2017

(87) PCT Pub. No.: WO2016/146780
PCT Pub. Date: Sep. 22, 2016

(65) Prior Publication Data

US 2018/0042294 A1 Feb. 15, 2018

(30) Foreign Application Priority Data

Mar. 17, 2015 (EP) ..... 15159518
Mar. 17, 2015 (EP) ..... 15159521

(51) Int. Cl.
*A24D 1/04* (2006.01)
*A24D 3/18* (2006.01)
*A24D 3/04* (2006.01)

(52) U.S. Cl.
CPC ..... *A24D 1/045* (2013.01); *A24D 1/04* (2013.01); *A24D 3/041* (2013.01); *A24D 3/043* (2013.01); *A24D 3/18* (2013.01)

(58) Field of Classification Search
CPC ..... A24D 3/041; A24D 3/043; A24F 13/02; A24F 13/04; A24F 13/22
See application file for complete search history.

(56) References Cited

U.S. PATENT DOCUMENTS 1,581,451 A 4/1926 Knapp
1,862,679 A 6/1932 Holsman
(Continued)

FOREIGN PATENT DOCUMENTS

CN 2257442 7/1997
CN 1200900 12/1998
(Continued)

OTHER PUBLICATIONS

PCT/EP2016/055877 International Search Report and Written Opinion dated Jun. 6, 2016 (10 pages).
(Continued)

*Primary Examiner* — Eric Yaary
(74) *Attorney, Agent, or Firm* — Mueting, Raasch & Gebhardt, P.A.

(57) ABSTRACT

A smoking article assembly (100) comprising a smoking article (80), and a tube (10) for temporary affixment to the smoking article. The smoking article comprises a tobacco rod, and a mouthpiece comprising a filter and a tipping wrapper, the tipping wrapper circumscribing the filter and attaching the filter to the tobacco rod. The tube is configured to be disposed around at least a portion of the mouthpiece such that the tube is slidable over the outer surface of the tipping wrapper. The tube comprises an open upstream end; an open downstream end; an outer surface; and an inner surface defining a lumen for receiving the mouthpiece of the smoking article, the lumen extending from the open upstream end to the open downstream end. The coefficient of static friction between the inner surface of the tube and the outer surface of the tipping wrapper may be between about
(Continued)

0.5 and about 0.9. The lumen may be substantially cylindrical and have a diameter that is between one percent and four percent greater than the average diameter of the smoking article mouthpiece.

10 Claims, 2 Drawing Sheets

(56) References Cited

U.S. PATENT DOCUMENTS

| | | | | |
|---|---|---|---|---|
| 2,718,889 | A | 9/1955 | Claussen | |
| 2,965,107 | A | 12/1960 | Lehv | |
| 3,260,266 | A | 7/1966 | Miller | |
| 3,977,416 | A | 8/1976 | Akiba | |
| 4,532,943 | A * | 8/1985 | Nichols | A24D 3/041 131/198.1 |
| 4,766,911 | A * | 8/1988 | Oglesby | A24C 5/601 131/281 |
| 5,992,420 | A | 11/1999 | Moriyama | |
| 2002/0083952 | A1 | 7/2002 | Braun | |
| 2011/0180081 | A1 * | 7/2011 | Fiebelkorn | A24D 3/041 131/198.2 |
| 2015/0034100 | A1 * | 2/2015 | Park | A24D 1/02 131/281 |
| 2015/0351451 | A1 * | 12/2015 | Kaljura | A24D 3/043 131/280 |

FOREIGN PATENT DOCUMENTS

| | | |
|---|---|---|
| CN | 1382402 | 12/2002 |
| DE | 20302406 | 4/2003 |
| GB | 294823 | 8/1928 |
| GB | 2210546 | 6/1989 |
| WO | WO 2013/083963 | 6/2013 |

OTHER PUBLICATIONS

PCT/EP2016/055877 International Preliminary Report on Patentability dated Apr. 26, 2017 (13 pages).

Gurnagul et al., "Factors Affecting the Coefficient of Friction of Paper", *Journal of Applied Polymer Science*, vol. 46, No. 5, Oct. 15, 1992, pp. 805-814.

European Extended Search Report for Application No. 15159518.8 dated Oct. 19, 2015 (6 pages).

Office Action issued in China for Application No. 201680009363.9 dated Nov. 13, 2019 (19 pages). English translation included.

* cited by examiner

SMOKING ARTICLE ASSEMBLY WITH A FITTED TUBE

This application is a U.S. National Stage Application of International Application No. PCT/EP2016/055877, filed Mar. 17, 2016, which was published in English on Sep. 22, 2016, as International Publication No. WO 2016/146780 A1. International Application No. PCT/EP2016/055877 claims priority to European Application No, 15159518.8 filed Mar. 17, 2015 and European Application No. 15159521.2 filed Mar. 17, 2015.

The present invention relates to a smoking article assembly comprising a smoking article, and a tube for temporary affixment to a mouthpiece of the smoking article (for example cigarettes). The invention also relates to a container containing such an assembly.

Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Generally, a consumer smokes a smoking article until the burning area of the tobacco rod reaches the edge of the tipping paper. This means that a small portion of the tobacco (where the tipping paper overlaps the tobacco rod) still remains unburnt and will continue to burn unless extinguished. Therefore, the consumer extinguishes the smoking article, typically by holding the filter and pressing the lit end of the smoking article against the base of an ashtray or other hard non-flammable surface. This disrupts the structure of the lit end and prevents oxygen reaching the burning tobacco, and burning usually stops rapidly. However, in the process of extinguishing the smoking article, the consumer's fingers may come into contact with, or close to, the lit end of the smoking article or old ash remaining in the ashtray.

Several solutions have therefore been proposed for extinguishing a smoking article in a safe, hygienic way. For example, it has been proposed to modify the burning characteristics of the paper surrounding the tobacco rod at or around its downstream end, so that the smoking article will effectively self-extinguish when the lit end reaches this modified section. However, in some circumstances, a consumer may wish to extinguish the cigarette before the lit end reaches the modified section of the wrapper, and thus need to extinguish the cigarette manually. Furthermore, the modified section may not always extinguish the lit end in a quick and reliably manner.

An alternative proposed solution is to provide a tube or sleeve that can slide over a smoking article and cover the lit end of the tobacco rod to extinguish the smoking article, after a consumer has finished smoking the smoking article. However, such tubes may only become usable at the end of the smoking cycle, at which point a consumer has to slide the tube over the smoking article to cover the lit end. This can be difficult if the smoking article length has shortened due to combustion of the tobacco rod. Furthermore, the tube may be effectively redundant until the consumer wishes to extinguish the smoking article.

It would therefore be desirable to provide a solution for extinguishing a smoking article in safe, hygienic, and usable way, whilst additionally providing extra functions or benefits during the smoking experience.

According to a first aspect of the present invention there is provided a smoking article assembly comprising a smoking article, and a tube for temporary affixment to the smoking article. The smoking article comprises a tobacco rod, and a mouthpiece comprising a filter and a tipping wrapper, the tipping wrapper circumscribing the filter and attaching the filter to the tobacco rod. The tube is configured to be disposed around at least a portion of the mouthpiece such that the tube is slidable over the outer surface of the tipping wrapper. The tube comprises an open upstream end; an open downstream end; an outer surface; and an inner surface defining a lumen for receiving the mouthpiece of the smoking article, the lumen extending from the open upstream end to the open downstream end. The coefficient of static friction between the inner surface of the tube and the outer surface of the tipping wrapper is between about 0.5 and about 0.9.

The present inventors have appreciated that it can be beneficial to dispose a tube around a mouthpiece of a smoking article and use such a tube to facilitate extinguishing of the smoking article. The present inventors have also appreciated that in order to make use of the tube during smoking, it would be desirable to have a tube that is easily slidable over different locations along the smoking article mouthpiece, but which, when no sliding force is applied to the tube by a consumer, would retain its position on the smoking article without assistance from a consumer. The inventors believe this can be achieved by forming the inner surface of the tube from a first material and the outer surface of the tipping wrapper from a second material such that the coefficient of static friction between the inner surface of tube and the outer surface of the tipping wrapper is between about 0.5 and about 0.9. This can provide a desired level of static friction between the two surfaces for a consumer to be able to easily slide the tube relative to the smoking article mouthpiece, but then remain in place relative to the smoking article mouthpiece when no external sliding force is being applied. By allowing for this customization of the tube location relative to the mouthpiece, a consumer can adjust the position of the tube relative to the mouthpiece during smoking to suit their particular preferences. For example, the tube could be located relative to the mouthpiece such that the open downstream end of the tube forms a mouth end cavity on a smoking article, or extends the length of an existing mouth end cavity on a smoking article. The length of the mouth end cavity and therefore the smoking experience can be adjusted based on the location of the tube relative to the mouthpiece. In preferred embodiments, the coefficient of static friction between the first material and the second material is between about 0.6 and about 0.8.

The coefficient static of friction can be determined by taking a sample of the first material that forms the inner surface of tube and a sample of the second material that forms the outer surface of the tipping wrapper, and measuring the coefficient static of friction between these in accordance with ISO 8295.

The term "inner surface" is used throughout the specification to refer to the side of the tube that faces towards the lumen. Likewise, the term "outer surface" is used throughout the specification to refer to the side of the tube that faces towards the exterior of the tube.

The terms "upstream" and "downstream" refer to relative positions of elements of the smoking article or mouthpiece described in relation to the direction of mainstream smoke as it is drawn from the aerosol generating substrate and through the filter or mouthpiece. Mainstream smoke flows generally parallel to the length of the smoking article, in the longitudinal direction. The transverse direction of the smoking article is perpendicular to the longitudinal direction.

Preferably, in the first aspect of the present invention, the lumen is substantially cylindrical and has a diameter that is between one percent and four percent greater than the average diameter of the smoking article mouthpiece, more preferably between two percent and three percent greater than the average diameter of the smoking article mouthpiece.

According to a second aspect of the present invention there is provided a smoking article assembly comprising a smoking article, and a tube for temporary affixment to the smoking article. The smoking article comprises a tobacco rod, and a mouthpiece comprising a filter and a tipping wrapper, the tipping wrapper circumscribing the filter and attaching the filter to the tobacco rod. The tube is configured to be disposed around at least a portion of the mouthpiece such that the tube is slidable over the outer surface of the tipping wrapper. The tube comprises an open upstream end; an open downstream end; an outer surface; and an inner surface defining a lumen for receiving the mouthpiece of the smoking article, the lumen extending from the open upstream end to the open downstream end. The lumen is substantially cylindrical and has a diameter that is between one percent and four percent greater than the average diameter of the smoking article mouthpiece. Preferably, the lumen has a diameter that is between one percent and four percent greater than the average diameter of the smoking article mouthpiece, more preferably between two percent and three percent greater than the average diameter of the smoking article mouthpiece.

The present inventors have identified that, surprisingly, the interaction between the tipping wrapper and the inner surface of the tube can be optimized when the diameter of the substantially cylindrical lumen is between one percent and four percent greater than the average diameter of the smoking article mouthpiece, more preferably between two percent and three percent greater than the average diameter of the smoking article mouthpiece. Without wishing to be bound by theory, it is believed that this effect is due to the fact that a smoking article mouthpiece (or tobacco rod) is not perfectly cylindrical, but instead has minor variations in its cross-sectional dimensions along the longitudinal axis, in particular the diameter. This variation results in regions of the smoking article mouthpiece (or tobacco rod) that can engage with the inner surface of the tube to resist movement of the mouthpiece relative to the tube. The inventors have found that if the diameter of the substantially cylindrical lumen is more than four percent greater than the average diameter of the smoking article mouthpiece, the inner surface of the tube may create too strong an engagement with the outer surface of the mouthpiece and thus make it difficult for a consumer to slide the tube over or around the mouthpiece. On the other hand, the inventors have also found that if the diameter of the substantially cylindrical lumen is not at least one percent greater than the average diameter of the smoking article mouthpiece, the inner surface of the tube may not sufficiently engage with the outer surface of the mouthpiece when the tube is disposed around the mouthpiece, thus risking the smoking article sliding out of the tube when a consumer holds the assembly by the tube, such as when the consumer puts the tube in their mouth.

The (mean) average diameter of the smoking article mouthpiece can be determined in a number of ways known to the skilled person. For example, as will be understood by a person skilled in the art, the (mean) average diameter of the smoking article mouthpiece can be determined by measuring the cross sectional area of the mouthpiece at the mouth end. This could be measured using, for example, a high resolution camera and appropriate image analysis software. The measured area can then be input into the standard formula for the area of a circle ($A=\pi r^2$), to determine the average radius of the mouth end of the mouthpiece, which can then provide the average diameter of the mouth end of the mouthpiece. The cross sectional area at the mouth end should be measured perpendicular to the longitudinal axis of the mouthpiece and the smoking article.

Preferably, in the second aspect of the present invention, the coefficient of static friction between the inner surface of the tube and the outer surface of the tipping wrapper is between about 0.5 and about 0.9, more preferably between about 0.6 and about 0.8.

Preferred features for both the first and second aspects of the present invention are described below.

In some preferred embodiments, the tube comprises a first ventilation zone for providing ventilation into the lumen of the tube, the first ventilation zone comprising a first line of perforation holes circumscribing the tube at a location between 10 mm and 15 mm from the open downstream end of the tube. It is often desirable to ventilate a mouthpiece of a smoking article to dilute the mainstream smoke that a smoker receives. Ventilation of mainstream smoke can be achieved with one or more rows of perforations in the tipping paper about a location along the mouthpiece. Known extinguishing tubes could occlude such holes and thus eliminate the ventilation that the holes were intended to provide.

By providing a tube having a first ventilation zone for providing ventilation into the lumen of the tube, the first ventilation zone comprising a first line of perforation holes circumscribing the tube at a location between 10 mm and 15 mm from the open downstream end of the tube, a consumer can slide the tube over the mouthpiece during smoking and utilise the line of perforation holes on the tube to provide a desired level of ventilation, even if the tube is occluding existing perforation holes on the smoking article mouthpiece. This advantageously allows a consumer to use the tube as an extension of the mouthpiece during smoking, without hindering or undesirably affecting their smoking experience. The tube can then remain on the mouthpiece until the consumer chooses to extinguish the cigarette. The consumer can use the tube as an extinguishing aid, by sliding the tube upstream along the mouthpiece, such that the lit end of the smoking article resides in the lumen of the tube and is thereby extinguished.

Furthermore, the tube in accordance with the first aspect of the invention provides a consumer with a novel way to create a mouth end cavity on a smoking article, or increase the length of an existing mouth end cavity on a smoking article, to customise their smoking experience.

Preferably, the first ventilation zone further comprises one or more additional lines of perforation holes circumscribing the tube at a location between 12 mm and 30 mm from the open downstream end of the tube. By providing one or more additional lines of perforation holes circumscribing the tube at a location between 12 mm and 30 mm from the open downstream end of the tube, a consumer can customise the level of ventilation that the tube contributes. For example, if the first ventilation zone consists of 3 lines of perforations, a consumer could locate the tube around the mouthpiece such that the two most upstream lines of perforations are occluded by the outer surface of the smoking article mouthpiece. In such a configuration, the most downstream line of perforations can provide ventilation into a mouth end cavity that is defined by the downstream end portion of the tube. If a consumer wishes to change the level of ventilation at any point during their smoking experience, they could slide the tube downstream relative to the smoking article, such that one or more of the two most upstream perforation lines are no longer occluded by the smoking article mouthpiece, and therefore are capable of contributing to the ventilation. This provides a consumer with the ability to customise the ventilation level, and consequently configure the smoking experience to their own particular preference.

Preferably, the tube further comprises a second ventilation zone for providing ventilation into the lumen of the tube, the second ventilation zone comprising a first line of perforation holes circumscribing the tube at a location between 10 mm and 15 mm from the open upstream end of the tube. By providing a second ventilation zone having a line of perforation holes circumscribing the tube at a location between 10 mm and 15 mm from the open upstream end of the tube, the tube is capable of providing ventilation, regardless of what orientation the consumer chooses to slide the tube over the smoking article mouthpiece.

Preferably, the second ventilation zone further comprises one or more additional lines of perforation holes circumscribing the tube at a location between 12 mm and 30 mm from the open upstream end of the tube. By providing one or more additional lines of perforation holes circumscribing the tube at a location between 12 mm and 30 mm from the open upstream end of the tube, a consumer can customise the level of ventilation that the tube contributes. For example, if the first ventilation zone consists of 3 lines of perforations, a consumer could locate the tube around the mouthpiece such that the two most upstream lines of perforations are occluded by the outer surface of the smoking article mouthpiece. In such a configuration, the most downstream line of perforations can provide ventilation into a mouth end cavity at the downstream end portion of the tube. If a consumer wishes to change the level of ventilation at any point during their smoking experience, they can simply slide the tube relative to the smoking article, such that one or more of the two most upstream perforation lines are no longer occluded by the smoking article mouthpiece, and therefore are capable of contributing to the ventilation into the mouth end cavity. This provides a consumer with the ability to customise the ventilation level, and consequently configure the smoking experience to their own particular preference.

In embodiments where the tube further comprises a second ventilation zone comprising a first line of perforation holes, preferably, the first line of perforation holes of the first ventilation zone is configured to provide a different level of ventilation than the first line of perforation holes of the second ventilation zone. This can provide a consumer with a further means for customising their smoking experience, since they can obtain a different level of ventilation depending on the orientation that the consumer chooses to slide the tube over the smoking article mouthpiece.

Preferably, the outer surface of the tube, the inner surface of the tube, or both, are provided with one or more indicia, wherein each indicia is configured to indicate the location of a respective line of perforation holes on the tube. This can advantageously help a consumer to locate the tube around the mouthpiece of the smoking article at a location that will provide a desired level of ventilation.

Preferably, a flavour delivery mechanism is provided on the inner surface of the tube, the outer surface of the tube, or both. In some preferred embodiments, the tube comprises a flavour delivery mechanism on the inner surface of the tube configured to release a first flavourant, and a flavour delivery mechanism on the outer surface of the tube configured to release a second flavourant. Preferably, the first flavourant is different from the second flavourant. For example, the inner surface of the tube may be configured to release a first flavourant for flavouring the smoke produced by a smoking article, and the outer surface of the tube may be configured to release a second flavourant for flavouring a consumer's lips, for flavouring a consumer's fingers, or both.

In some preferred embodiments, the flavour delivery mechanism is provided on only a portion of the outer surface, a portion of the inner surface, or both. For example, in some preferred embodiments a flavour delivery mechanism is provided only at the upstream end of the tube. This can be advantageous if the flavourant is provided to mask or negate the smells created when a smoking article is extinguished. Alternatively or additionally, a flavour delivery mechanism may be provided only on the downstream end of the outer surface of the tube. This can be advantageous if the flavour delivery mechanism includes a flavourant for flavouring a consumer's lips.

Preferably, the flavour delivery mechanism is configured to release flavourant in response to one or more trigger events. Preferred trigger events include movement of the tube relative to the smoking article when the tube is affixed to the smoking article, the addition of moisture, a change of pH, a temperature increase, and combinations thereof.

A particularly preferred trigger event is movement of the tube relative to the smoking article when the tube is affixed to the smoking article. This could be by moving the tube laterally over the mouthpiece, by moving the tube rotationally around the mouthpiece, or both. However, in some particularly preferred embodiments, it is preferable for the flavourant to be released in response to rotational movement of the tube around the mouthpiece, since this can allow a consumer to choose precisely when the trigger mechanism is activated. An indicia may be provided on the outer surface of the tube for informing the consumer that rotational movement of the tube around the mouthpiece can release flavourant.

In some preferred embodiments, the flavour delivery mechanism comprises a plurality of frangible flavour containers provided on a surface of the tube, wherein the plurality of frangible flavour containers are adapted to be manually ruptured by a consumer during use, to release a flavour from within the containers. Where the frangible flavour containers are provided on the outer surface of the tube, the consumer can rupture the containers with their fingers, for example, to transfer flavour to their fingers. Alternatively or additionally, the frangible containers may be provided on the inner surface of the tube. In such embodiments, the consumer can rupture the frangible containers on the inner surface of the tube by moving the tube laterally over the mouthpiece, by moving the tube rotationally around the mouthpiece, or both.

The term "frangible flavourant containers" is used herein to mean any container which is suitable for housing a flavourant and which can be manually ruptured by a consumer. Preferably the frangible flavourant containers are frangible microcapsules. Therefore, further aspects of the invention may be described with reference to frangible microcapsules, although the skilled person will understand that such aspects are equally applicable when used with other forms of frangible flavourant container.

The term "flavourant" used throughout this specification, should be interpreted to include a gustatory sensation (taste), an olfactory sensation (smell), or both a gustatory sensation and an olfactory sensation. For example, the flavourant may impart a taste onto a consumer's fingers or into the mainstream smoke to enhance the mainstream smoke, or both. Alternatively or additionally, the flavourant may impart a fragrance onto a consumer's fingers, for example a fresh fragrance after smoking, or into the mainstream smoke, or both.

In one embodiment, the flavour delivery mechanism is configured to release flavourant in response to exposure to moisture from, for example, the smoke produced by the smoking article or the lips or mouth of a consumer. In another embodiment, heat from the lit end of the smoking article or from the user's mouth or lips may cause the flavour delivery mechanism is to release flavourant. In yet another embodiment, the flavour delivery mechanism is configured to release flavourant in response to a change in pH. The change in pH may occur when the flavour delivery mechanism is placed in an environment such as consumer's mouth.

Preferably, the flavourant is suitable for interacting with and modifying the characteristics of the smoking article and thus the smoke derived therefrom. For example, the flavourant may impart a flavour to enhance the taste of the mainstream smoke produced during smoking. In that case, when the flavourant is released, the consumer may experience a new smoking sensation due to the modified mainstream smoke.

Suitable flavourants or flavourings include, but are not limited to, menthol, mint, such as peppermint and spearmint, eucalyptus, sage, chocolate, liquorice, citrus and other fruit flavourants, gamma octalactone, vanillin, ethyl vanillin, breath freshener flavourants, spice flavourants such as cinnamon, methyl salicylate, linalool, bergamot oil, geranium oil, lemon oil, ginger oil, and tobacco flavourant. Other suitable flavourants may include flavourant compounds selected from the group consisting of an acid, an alcohol, an ester, an aldehyde, a ketone, a pyrazine, combinations or blends thereof and the like.

Preferably, the outer diameter of the tube at the open upstream end is at least about 90 percent of the outer diameter of the tube at the open downstream end, more preferably at least about 95 percent of the outer diameter of the tube at the open downstream end. In particularly preferred embodiments the outer surface of the tube is substantially cylindrical. That is, preferably the outer diameter of the tube at the open upstream end is substantially the same as the outer diameter of the tube at the open downstream end.

Preferably, the inner diameter of the tube at the open upstream end is at least about 90 percent of the inner diameter of the tube at the open downstream end, more preferably at least about 95 percent of the inner diameter of the tube at the open downstream end. In particularly preferred embodiments the inner surface of the tube is substantially cylindrical. This can ensure that the cross-section of the lumen in the tube remains substantially cylindrical, which can assist with afffixment of the tube to the smoking article.

Preferably, the inner diameter of the tube at the open upstream end is at least about 90 percent of the outer diameter of the tube at the open upstream end, more preferably at least about 95 percent of the outer diameter of the tube at the open downstream end. This means that the tube can be affixed to the smoking article without greatly increasing the radial dimension or appearance of the smoking article.

Preferably, the inner diameter of the tube at the open downstream end is at least about 90 percent of the outer diameter of the tube at the open downstream end, more preferably at least about 95 percent of the outer diameter of the tube at the open downstream end. This means that the tube can be affixed to the smoking article without greatly increasing the radial dimension or appearance of the smoking article.

Preferably, the lumen is configured to receive the entire smoking article mouthpiece of the smoking article.

Preferably, the tube has a length of between about 30 millimetres and about 70 millimetres, more preferably between about 37 mm and about 60 mm. In some preferred embodiments, the tube has a length of about 45 mm. This can advantageously allow the tube to be disposed around at least a substantial portion of the mouthpiece of a smoking article during smoking. Furthermore, this can advantageously allow a consumer to slide the upstream end of the tube beyond the upstream end of the mouthpiece, when extinguishing the smoking article, without the downstream end of the tube moving upstream of the downstream end of the mouthpiece.

Preferably, the inner diameter of the tube is between about 7.8 mm and about 8.2 mm, between about 6.8 mm and about 7.2 mm, or between about 5.8 mm and about 6.2 mm. The outer diameter of the tube is preferably between about 0.4 mm and 1.0 mm greater than the inner diameter of the tube.

The tube may be formed of any suitable material or materials. In some embodiments, the tube is formed from paper, such as spirally wound paper. This may be advantageous when the tube is intended for a single use. In some other embodiments, the tube can be formed from a plastic or polymeric material, or a metallic material. This may be advantageous when the tube is intended to be reusable.

In some particularly preferred embodiments, the tube comprises a tubular body and a wrapper wrapped around the tubular body. In such embodiments, the tubular body can define the inner surface of the tube, and the wrapper can define the outer surface of the tube. Preferably, the wrapper is made from paper. Preferably, the wrapper is made from tipping paper. For example, the wrapper preferably has a basis weight of between about 25 grams per square metre squared and about 150 grams per square metre, more preferably between about 25 grams per square metre and about 100 grams per square metre. Preferably, the wrapper has a thickness of between 50 micrometres and 250 micrometres, more preferably between 100 micrometres and 200 micrometres. Such an arrangement can advantageously help the outer surface of the tube to exhibit similar properties to the outer surface of a conventional smoking article, whilst also ensuring the tube remains sufficiently rigid and durable for slidable affixment to the mouthpiece of the smoking article.

The tube may be provided with one or more indicia on its inner surface, its outer surface, or both. Alternatively or additionally, the smoking article may be provided with one or more indicia. The term "indicia" is used to refer to a discrete visual element, or repeating visual elements or patterns that provides an aesthetically pleasing or informative representation. The indicia may be in the form of text, images, letters, words, logos, patterns or a combination thereof. For example, the indicia could be used to indicate to a consumer which end of the tube is the upstream end and which end is the downstream end. Alternatively or additionally, the indicia could be used to indicate to a consumer that flavourant could be released by application of a force to a specific portion of the tube, or by a specific movement of the tube with respect to a smoking article (such as by rotating the tube around the circumference of the smoking article). Alternatively or additionally, the smoking article may be provided with one or more indicia, wherein each indicia is configured to indicate how a consumer could align the tube relative to the smoking article to provide a desired level of ventilation.

The smoking article assembly may be provided in an assembled form, in which case the tube is already disposed around and temporarily affixed to the mouthpiece of the smoking article. In this case a consumer can immediately smoke the smoking article, and optionally adjust the location of the tube relative to the mouthpiece as they desire. Alternatively, the smoking article assembly may be provided in an unassembled form, in which case the tube is not yet disposed around and temporarily affixed to the mouthpiece of the smoking article. In this case a consumer can slide the tube over the smoking article mouthpiece to a desired location and then begin to smoke the smoking article. The smoking article assembly may therefore be provided as a kit, preferably with instructions for assembling the kit. Accordingly, according to a third aspect of the present invention, there is provided a kit of component parts capable of being assembled, the kit comprising a smoking article and a tube according to the first aspect of the invention or the second aspect of the invention. The component parts capable of being assembled may have any of the preferred features described above in respect of the first aspect of the invention or the second aspect of the invention.

The smoking article is preferably a filter cigarette comprising a rod of tobacco cut filler surrounded by a paper wrapper and a cylindrical filter aligned in end-to-end relationship with the wrapped tobacco rod, with the filter attached to the tobacco rod by tipping paper. Preferably, the filter comprises a plug of filtration material wrapped in a plug wrap. The filter cigarette may comprise a multi-component filter that comprises two or more segments of filtration material for the removal of particulate and gaseous components of the mainstream smoke.

According to a fourth aspect of the present invention, there is provided a container containing one or more of the smoking article assemblies according to the first aspect of the invention or the second aspect of the invention. The one or more of the smoking article assemblies contained within the container may have any of the preferred features described above in respect of the first aspect of the invention or the second aspect of the invention. The container may have any suitable shape or configuration. Preferably, the container is a hinge-lid pack of the type generally used to contain conventional smoking articles. An advantage of such a container is that the one or more tubes can be longitudinally aligned in the container, such that when the lid is opened, the open ends of the tubes are exposed and facing upwards. This can make it easier for a consumer to affix a smoking article to a tube, by simply holding the pack in one hand and inserting the smoking article mouthpiece into an exposed open end of a tube in a pack with the other hand. Accordingly, preferably the tubes are arranged in the container, such that when the container is opened, at least one tube is arranged such that it has an open end that is exposed to the exterior of the container. Preferably, the tubes are axially aligned and held in place within the container.

The container may only contain the tubes as described above. Alternatively, in some embodiments, the container may also contain one or more smoking articles, for which the tubes can be affixed to. These smoking articles may include a mouth end cavity. The tubes may be provided in the container adjacent to a smoking article, in which case a consumer can affix the tube to the mouthpiece of the smoking article when they wish to smoke the smoking article. Alternatively, the one or more tubes may already be affixed to a respective smoking article in the container, such that a consumer can remove the tube and its associated smoking article from the container in a single action.

The invention will be further described, by way of example only, with reference to the accompanying drawings in which:

FIG. 1 shows a tube (10) for temporary affixment to a mouthpiece of a smoking article. The tube (10) has an open downstream end (40) and an open upstream end (60).

Figure 1:
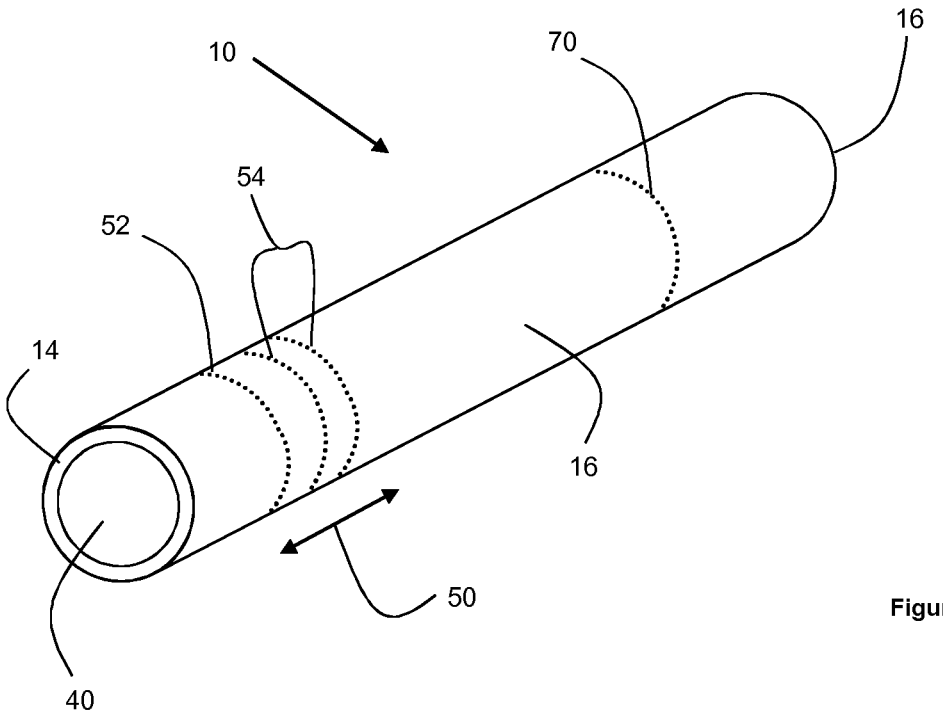
FIG. 1 is a perspective view of a tube for temporary affixment to a smoking article according to an embodiment of the invention.

The tube is hollow and has a lumen extending from the open upstream end (60) to the open downstream end (40) for receiving a mouthpiece of a smoking article. The tube (10) has a first ventilation zone (50) comprising a plurality of lines of ventilation holes (52, 54), in this case three lines. A first line of ventilation holes (52) is provided at a location between 10 mm and 15 mm from the open downstream end (40) of the tube (10).

The tube in FIG. 1 also includes a second ventilation zone having a line of perforation holes (70) at a location between 10 mm and 15 mm from the open upstream end (60) of the tube (10). The tube (10) is formed from a tubular body (14) that defines an inner surface of the tube, and an outer wrapper (16) that defines an outer surface of the tube (10). In the embodiment of FIG. 1, the outer wrapper (16) is preferably a tipping paper.

Figure 2:
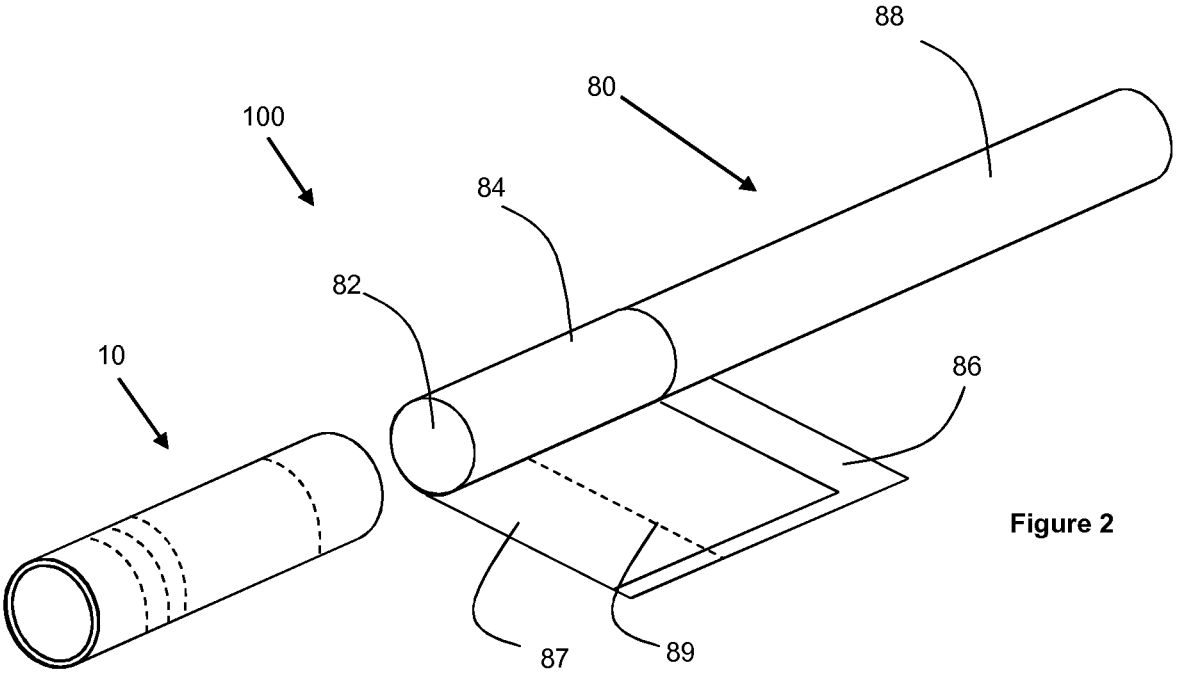
FIG. 2 is a perspective view of a smoking article and the tube of FIG. 1 in an unassembled condition.

FIG. 2 shows the tube (10) of FIG. 1 together with a smoking article (80) in an unassembled condition. The smoking article (80) comprises a tobacco rod (88) and a filter (84) that secured together by a tipping paper (86). The tipping paper (86) and the filter plug wrap (87) are shown in an unassembled condition for clarity. A line of perforation holes (89) is provided on the tipping paper (86) and the filter plug wrap (87). The filter (84) has a downstream mouth end (82). As can be seen from FIG. 2, the lumen of the tube (10) is shaped and sized such that tube (1) can slide over and become affixed to the filter (84) of the smoking article (80). Although not specifically visible in FIG. 2, coefficient of static friction between the inner surface of the tube (10) and the outer surface of the tipping wrapper (86) is between about 0.5 and about 0.9, and the lumen of the tube (10) is substantially cylindrical and has a diameter that is between one percent and four percent greater than the average diameter of the filter (84).

Figure 3:
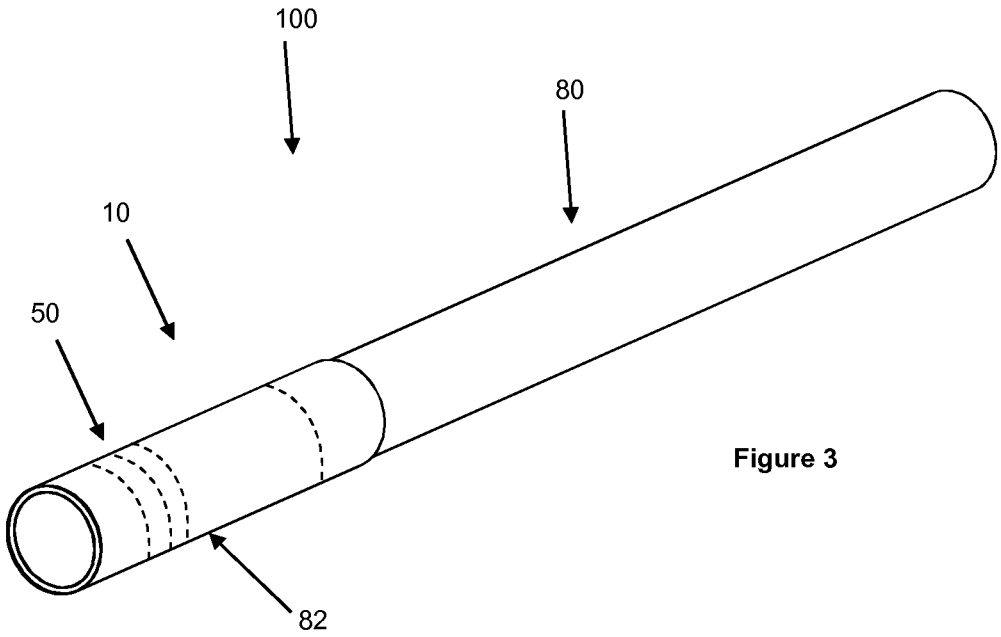
FIG. 3 is a perspective view of a smoking article and the tube of FIG. 1 in an assembled condition.

FIG. 3 shows a configuration (100) in which the tube (10) is affixed to the smoking article (80). Although not visible from this exterior perspective view, the mouth end of the smoking article (82) is located slightly upstream of the first ventilation zone (50) on the tube (10). This arrangement would result in the downstream end of the tube (10) defining a mouth end cavity, and ventilation being provided into the mouth end cavity by the perforation lines (52, 54) of the first ventilation zone (50).

After a consumer has finished smoking the smoking article (80) they can then slide the tube (10) upstream, such that the lit end of the tobacco rod (88) is covered by the upstream end of the tube (10) and thereby extinguished. Any loose tobacco or embers may be retained within the lumen of the tube (10) to minimise the possibility of these coming into contact with a consumer's fingers.

The invention claimed is:

1. A smoking article assembly comprising:

a smoking article, and a tube for temporary affixment to the smoking article;

wherein the smoking article comprises:

a tobacco rod;

a mouthpiece comprising a filter and a tipping wrapper, the tipping wrapper circumscribing the filter and attaching the filter to the tobacco rod; and wherein the tube is configured to be disposed around at least a portion of the mouthpiece such that the tube is slidable in either orientation over the outer surface of the tipping wrapper, the tube comprising:

an open upstream end;

an open downstream end;

an outer surface;

an inner surface defining a lumen for receiving the mouthpiece of the smoking article, the lumen extending from the open upstream end to the open downstream end;

a first ventilation zone for providing ventilation into the lumen of the tube, the first ventilation zone comprising a first line of perforation holes circumscribing the tube at a location between 10 mm and 15 mm from the open downstream end of the tube; and a second ventilation zone for providing ventilation into the lumen of the tube, the second ventilation zone comprising a first line of perforation holes circumscribing the tube at a location between 10 mm and 15 mm from the open upstream end of the tube, wherein the coefficient of static friction between the inner surface of the tube and the outer surface of the tipping wrapper is between about 0.5 and about 0.9;

and wherein the first line of perforation holes of the first ventilation zone is configured to provide a different level of ventilation than the first line of perforation holes of the second ventilation zone.

2. A smoking article assembly according to claim 1, wherein the coefficient of static friction between the inner surface of the tube and the outer surface of the tipping wrapper is between about 0.6 and about 0.8.

3. A smoking article assembly according to claim 1, wherein the first ventilation zone further comprises one or more additional lines of perforation holes circumscribing the tube at a location between 12 mm and 30 mm from the open downstream end of the tube.

4. A smoking article assembly according to claim 1, wherein the outer surface of the tube, the inner surface of the tube, or both, are provided with one or more indicia for indicating the location of a respective line of perforation holes of the first ventilation zone.

5. A smoking article assembly according to claim 1, wherein flavourant is provided on the inner surface of the tube, the outer surface of the tube, or both.

6. A smoking article assembly according to claim 5, wherein the flavourant is configured to be released in response to movement of the tube over or around the mouthpiece of the smoking article.

7. A smoking article assembly according to claim 1, wherein the outer diameter of the tube at the open upstream end is at least about 90 percent of the outer diameter of the tube at the open downstream end.

8. A smoking article assembly according to claim 1, wherein the inner diameter of the tube at the open upstream end is at least about 90 percent of the inner diameter of the tube at the open downstream end.

9. A smoking article assembly according to claim 1, wherein the tube has a length of between about 30 millimetres and about 70 millimetres.

10. A smoking article assembly according to claim 1, wherein the tube further comprises a tubular body and a wrapper wrapped around the tubular body.

* * * * *